US005256098A

United States Patent [19]

Smith et al.

[11] Patent Number: 5,256,098

[45] Date of Patent: Oct. 26, 1993

[54] DOLL PLAYSET HAVING SIMULATED FETAL KICKING AND HEARTBEAT

[75] Inventors: Robin K. Smith, Long Beach; Howard R. Stern, Redondo Beach, both of Calif.

[73] Assignee: Mattel, Inc., El Segundo, Calif.

[21] Appl. No.: 833,189

[22] Filed: Feb. 10, 1992

[51] Int. Cl.[5] ..... A63H 33/00; A63H 3/00; G09B 23/28

[52] U.S. Cl. ..... 446/28; 446/73; 446/295; 434/266

[58] Field of Search ..... 446/26, 28, 71, 72, 446/73, 81, 268, 295, 296, 297, 298, 303, 320, 321, 419, 422; 434/266, 262, 273

[56] References Cited

U.S. PATENT DOCUMENTS

| | | | |
|---|---|---|---|
| 1,768,334 | 6/1930 | Stein et al. | 446/297 |
| 2,593,218 | 4/1952 | Swain | 446/28 X |
| 2,628,452 | 2/1953 | Gladstein | 446/28 |
| 3,014,312 | 12/1961 | Convertine | 446/295 |
| 3,137,092 | 6/1964 | Salerno . | |
| 3,184,886 | 5/1965 | Weih | 446/295 |
| 3,298,132 | 1/1967 | Elwell | 446/295 |
| 3,822,486 | 7/1974 | Knapp et al. . | |
| 4,149,687 | 4/1979 | Nunemacher . | |
| 4,155,196 | 5/1979 | Bollinger et al. . | |
| 4,166,337 | 9/1979 | Kosicki et al. . | |
| 4,411,629 | 10/1983 | Voights . | |
| 4,605,380 | 8/1986 | Camm et al. . | |
| 4,718,876 | 1/1988 | Lee | 446/295 |
| 4,853,994 | 8/1989 | Ekstein | 446/73 X |
| 4,889,512 | 12/1989 | Burnett et al. | 446/72 |

FOREIGN PATENT DOCUMENTS

| | | | |
|---|---|---|---|
| 9110489 | 7/1991 | PCT Int'l Appl. | 446/72 |

*Primary Examiner*—Robert A. Hafer
*Assistant Examiner*—D. Neal Muir
*Attorney, Agent, or Firm*—Roy A. Ekstrand

[57] ABSTRACT

A doll playset includes a padded cloth pouch having an interior within which a small doll heartbeat and kick simulating unit are received and supported. A pair of shoulder straps are secured to the pouch to facilitate the wearing of the pouch on the front abdominal area of a child user. The heartbeat and kick simulator includes a motor driven mechanism which produces undulating motion of a pair of kick simulating buttons supported upon the front surface of the simulator. A triangular cam is coupled to the undulating mechanism to provide flexing of an elongated resilient sounder resulting in heartbeat-like sounds when the unit is activated. A push button is supported upon the front surface of the simulator and may be depressed to operate the unit from the exterior of the cloth pouch.

7 Claims, 1 Drawing Sheet

DOLL PLAYSET HAVING SIMULATED FETAL KICKING AND HEARTBEAT

FIELD OF THE INVENTION

This invention relates generally to doll playsets and particularly to those using heartbeat simulation.

BACKGROUND OF THE INVENTION

For many years, dolls have been created which are intended to simulate various activities of babies or young children. In addition, many dolls have been created which provide play patterns including various human functions such as eating, sleeping, crying and the like. An additional type of doll created to amuse and educate young children is that in which various physiological activities such as heartbeat or the like are simulated.

For example, U.S. Pat. No. 4,155,196 issued to Bollinger, et al. sets forth a PLAY METHOD AND APPARATUS FOR PRODUCING A HEARTBEAT-LIKE SOUND in which a toy stethoscope includes a probe containing therein a normally open reed switch which is closed to produce a heartbeat-like sound when the probe is near a magnet embedded within the doll body.

U.S. Pat. No. 4,605,380 issued to Camm, et al. sets forth a HEARTBEAT DOLL having a solenoid activated mechanism driven by a pulse generator which cause a plunger to strike the inner chest wall of the doll and produce a simulated heartbeat. In an alternate embodiment, a temperature sensor is mounted on a surface portion of the doll to control the pulse rate generator.

U.S. Pat. No. 4,166,337 issued to Kosicki, et al. sets forth a DOLL WITH HEARTBEAT SIMULATOR having a hollow cavity within the doll body which supports a motor driven plunger. A sounding cavity within the doll body supports a diaphragm coupled to the motor driven plunger such that the diaphragm is moved under the urging of the plunger motion to provide the simulation of heartbeat movement and sound.

U.S. Pat. No. 3,137,092 issued to Salerno sets forth a MECHANISM FOR SIMULATING SOUNDS AND VIBRATIONS OF A HEARTBEAT in which a housing supports a motor driven cogged wheel together with a pair of pivotally mounted sounding arms. The cogged wheels pivots the arms as the cogs move past the end portions of the arms. A return spring causes the displaced arms to return rapidly against a sound element to produce a heartbeat sound.

U.S. Pat. No. 4,411,629 issued to Voights sets forth a PALPITATION AND AUSCULATATION TEACHING METHOD AND APPARATUS which simulates the fetus in a pregnant female. A cushion pouch receives a fetal size doll and includes means for securing to a female model to simulate pregnancy. Means are provided for producing heartbeat sounds and other fetal responses with the intention of providing a convenient means for practicing fetal examination.

U.S. Pat. No. 3,822,486 issued to Knapp, et al. sets forth DYNAMIC CHILDBIRTH SIMULATOR FOR TEACHING MATERNITY PATIENT CARE including a life-size mannequin configured to replicate a pregnant human female. A fetal doll is received within the simulated pregnant female which produces simulated heartbeats and the like.

U.S. Pat. No. 4,149,687 issued to Nunemacher sets forth a BABY POUCH in which a fabric configured to receive an upright infant includes a plurality of support straps for use by a person carrying an infant in securing the baby pouch to the front torso of the wearer.

While the foregoing described devices have provided some increase in the realism of heartbeat related activities for dolls and the like, there remains a continuing need in the art for evermore improved and more interesting and amusing types of dolls and doll playsets.

SUMMARY OF THE INVENTION

Accordingly, it is a general object of the present invention to provide an improved doll playset. It is a more particular object of the present invention to provide an improved doll 10 playset which produces simulated heartbeat and kicking actions of the type generally related to fetal humans.

In accordance with the present invention, there is provided a doll playset comprising: a pouch having a front surface, a rear surface and an interior pocket; a kick and heartbeat simulator supported within the interior pocket having a plurality of undulating members and means for producing a heartbeat-like sound; and a doll removably supported within the interior pocket.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
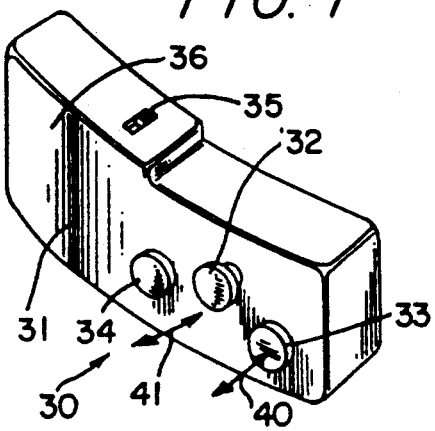
FIG. 1 sets forth a front perspective view of a child wearing the present invention doll playset.

FIG. 1 sets forth a front perspective view of a child 11 wearing and using a doll playset constructed in accordance with the present invention and generally referenced by numeral 10. Playset 10 includes a soft preferably padded cloth pouch 12 having a front portion 21 and a rear portion 22 joined about their coextensive outer edges to form an interior pocket therein. A separable seam 20 is formed across the upper portion of pouch 12 and serves to join front portion 21 to rear portion 22 in a separable attachment. In its preferred form, it has been found convenient to utilize a hook and loop fabric attachment mechanism between front portion 21 and rear portion 22 along separable seam 20. It will be apparent, however, to those skilled in the art that other mechanisms for providing access to the interior of cloth pouch 12 may be utilized without departing from the spirit and scope of the present invention.

In accordance with the present invention, a doll 30 preferably formed to replicate an extremely young human infant is supported within the interior of cloth pouch 12 by a retaining belt 23. Retaining belt 23, in its preferred form, comprises an elastic transverse belt sufficient to retain the weight of doll 30. In accordance with an important aspect of the present invention, a heartbeat and kick simulator 30, the structure of which is set forth below in greater detail is supported within the interior of cloth pouch 12 and is preferably positioned against the inside surface of front portion 21 of cloth pouch 12. In further accordance with the present invention, heartbeat and kick simulator 30 includes a housing 31 which in turn supports an on/off button 34 and a pair of kick simulating buttons 32 and 33. The structure of heartbeat and kick simulator 30 is set forth below in greater detail. However, suffice it to note here that the pressing of on/off button 34 against housing 31 causes kick simulating buttons 32 and 33 to move outwardly and back with respect to housing 31 in a more or less random fashion.

Thus, in the anticipated play pattern which child 11 simulates, the child user places one hand such as hand 15 against front surface 21 of cloth pouch 12 in a position generally overlying heartbeat and kick simulator 30. When so positioned, an inward pressure upon front surface 21 depresses on/off button 34 causing a out and back movement of buttons 32 and 33 which the child senses or feels through the front portion of pouch 12. In its preferred form, this forth and back motion of buttons 32 and 33 is selected to resemble the kicking motions typically felt by touching the abdomen of a pregnant female. Simultaneously, with the kick simulating motion of buttons 32 and 33, a heartbeat simulator (better seen in FIG. 5) produces a vibration and sound similar to a fetal heartbeat which is sensed and heard by the child user.

Thus, in accordance with the anticipated play pattern of the present invention doll playset, the wearer of pouch 12 may press the front portion thereof and receive the tactile feel and sounds characteristic of a fetal kicking and heartbeat. In addition, the wearer may invite other children to place a hand upon the front lower portion of pouch 12 and obtain the same sensations of feeling a simulated fetal kick and heartbeat sensation. The latter play pattern is intended to mimic the well known activity in which a child places his or her hand upon the abdomen of their mother and senses the kicking and heartbeat of the unborn child being carried by the mother. In addition, the separation of seam 20 provides the above-mentioned access to the interior of pouch 12 and thus permits the withdrawing of doll 30 from the interior of the pouch. In addition, heartbeat and kick simulator 30 is similarly removable from the interior of pouch 12 for replacement of its internal batteries or similar activity.

Figure 2:
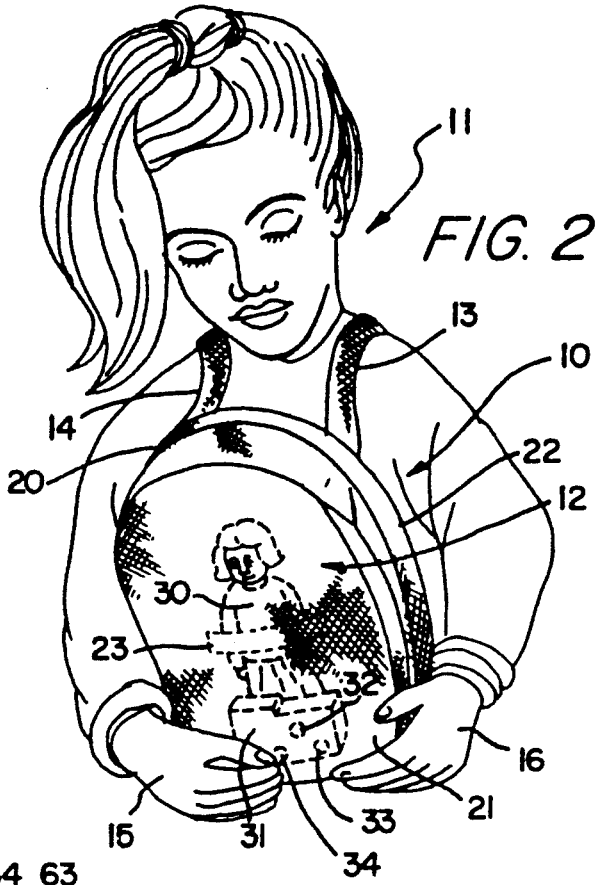
FIG. 2 sets forth a perspective view of the heartbeat and kicking simulator portion of the present invention doll playset.

FIG. 2 sets forth a front perspective view of the present invention heartbeat and kick simulator generally referenced by numeral 30. Heartbeat and kick simulator 30 defines a generally curved housing 31 intended to provide a curved or rounded front surface for realistic feel when situated within pouch 12 as described above. Heartbeat and kick simulator 30 includes a depressible on/off button 34 as well as a battery saving or defeat switch 35. By means not shown but in accordance with conventional fabrication techniques, switch 35 provides an interruption of the battery power circuit to prevent inadvertent discharge and wasting of the batteries within simulator 30.

In accordance with an important aspect of the present invention, simulator 30 supports a pair of movable generally disk-shaped buttons 32 and 33 which, in accordance with the mechanism set forth below in greater detail, are moved back and forth from front surface 36 of housing 31 in the directions indicated by arrows 40 and 41.

Figure 3:
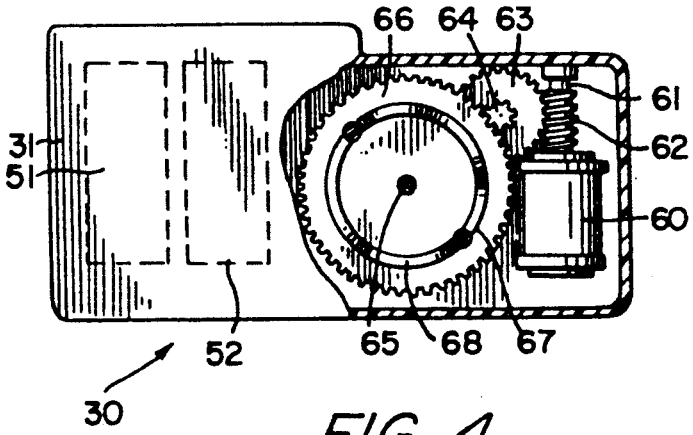
FIG. 3 sets forth a partially sectioned front view of the kicking and heartbeat simulator of the present invention doll playset.

FIG. 3 sets forth a partially sectioned front view of heartbeat and kick simulator 30 constructed in accordance with the present invention. As described above, heartbeat and kick simulator 30 includes a curved housing 31 which supports an on/off button 34 and simulated kick buttons 32 and 33 (seen in FIG. 2). Housing 31 is preferably formed of a molded plastic material or the like and defines an interior cavity 50. Cavity 50 supports a pair of conventional batteries 51 and 52. A motor 60 is operatively coupled to batteries 51 and 52 as well as on/off button 34 and battery switch 3 (seen in FIG. 3) using conventional electrical connection means (not shown). Motor 60 includes a rotatable output shaft 61 which supports a worm gear 62. A gear 63 is rotatably supported within interior cavity 50 and engages worm gear 62 such that rotation of worm gear 62 produces a corresponding rotation of gear 63. A reduced diameter gear 64 is operatively coupled to gear 63 and rotatable therewith. A support shaft 65 is received within interior cavity 50 and, by conventional fabrication means, supports a gear 66 in engagement with gear 64. In accordance with the present invention, gear 66 includes a cam 67 defining an undulating cam surface 68 extending forwardly from the front surface of gear 66.

In operation, motor 60 when energized rotates worm gear 62 which in turn causes rotation of gears 63, 64 and 66. By means set forth below in greater detail, the rotation of gear 66 produces an undulating motion of kick simulating buttons 32 and 33 (seen in FIG. 4) as well as a simulated heartbeat sound and vibration by means better seen in FIG. 5.

Figure 4:
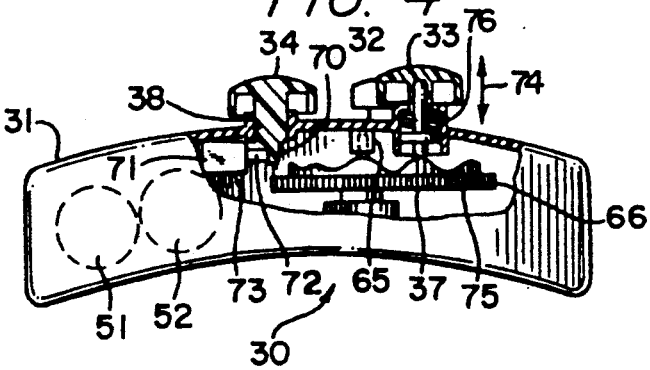
FIG. 4 sets forth a partially sectioned bottom view of the kicking and heartbeat simulator of the present invention doll playset.

FIG. 4 sets forth a partially sectioned bottom view of heartbeat and kick simulator 30. Simulator 30 includes a molded plastic housing 31 defining an interior cavity 50. A pair of conventional batteries 51 and 52 are supported within housing 31 by conventional wiring means 73. An on/off button 34 is received within an aperture 38 formed in the front surface of housing 31. Switch 71 includes a push button actuator 72 extending therefrom. On/off button 34 includes a push rod 70 having a tapered surface which cooperates with actuator 72 such that depressing on/off button 34 causes actuator 72 to be moved which in turn closes switch 71 and couples the battery power of batteries 51 and 52 to motor 60 (seen in FIG. 3).

As described above, housing 31 supports kick simulating buttons 32 and 33. It should be understood that kick simulating buttons 32 and 33 are identical in fabrication and thus the description which follows of button 33 should be understood to apply equally well and be equally descriptive of button 32. Accordingly, housing 31 defines an extending cylindrical boss 78 which in turn supports a keeper flange 77 and a return spring 76. Button 33 in turn includes a cylindrical push rod 75 which extends through boss 78 and keeper 77 and is slidably movable therein. In accordance with conventional fabrication techniques, keeper 77 is coupled to push rod 75 in a manner permitting reciprocating motion of push rod 75 while precluding the extension thereof beyond the point shown in FIG. 4. Spring 76 is captivated within boss 78 and produces a return force which urges keeper 77 and push rod 75 downwardly against cam surface 68 of cam 67. Correspondingly, push button 32 includes an extending push rod 37 which is similarly spring-loaded to extend downwardly to maintain contact with cam surface 68 of cam 67. As can be seen, cam surface of cam 67 provides a randomly undulating surface which rotates beneath push rods 75 and 37 of push buttons 33 and 32 respectively to produce a corresponding undulating motion of buttons 32 and 33 in the directions indicated by arrows 74.

Figure 5:
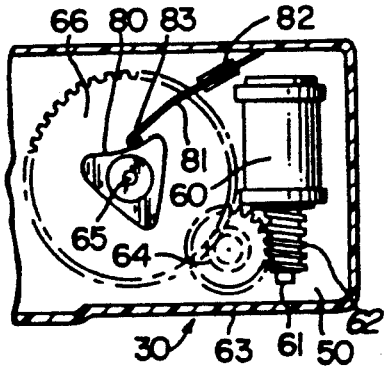
FIG. 5 sets forth a partial sectioned rear view of the heartbeat and kicking simulator of the present invention doll playset.

FIG. 5 sets forth a partial section view of the rear portion of heartbeat and kick simulator 30. Simulator 30 includes a molded plastic housing 31 defining an interior cavity 50 within which a motor 60 is supported.

As described above, motor 60 includes an output shaft 61 which supports a worm gear 62. The rotation of worm gear 62 produces a corresponding rotation of gears 63 and 64 which in turn drives a gear 66. Gear 66 supports a three-lobed generally triangular cam 80 on the side thereof reverse from cam 67. Thus, the rotation of gear 66 due to the rotation of worm gear 62 and gears 63 and 64 produces a corresponding rotation of triangular cam 80. A resilient elongated sounding element 81 is received and supported within housing 31 by a support 82. Sounder 81 defines a rounded end portion 83 which is maintained in contact with the surface of triangular cam 80 by the resilience of sounder 81.

In operation, the above-described energizing of motor 60 and rotation of worm gear 62 and gears 63 and 64 causes a corresponding rotation of gear 66. As gear 66 rotates, triangular cam 80 also rotates. End 83 of resilient sounder 81 is moved by the rotation of cam 80 causing sounder 81 to be flexed and released to produce a heartbeat-like sound and vibration.

What has been shown is a novel doll playset having a soft padded cloth pouch within which a motor driven heartbeat and kick simulator is supported together with a small doll. The simulator produces heartbeat sounds and fetal kicking action each time the exterior front surface of the pouch is touched.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll playset comprising:

a pouch having a front surface, a rear surface and defining an interior pocket;

a doll removably supported within said interior pocket; and a kick and heartbeat simulator external to and separate from said doll supported within said interior pocket having a means for producing a heartbeat-like sound and having a plurality of undulating members moving against the pocket interior to undulate said front surface to simulate a kicking movement therewithin, said doll being removable from said interior pocket free of said kick and heartbeat simulator for play while said kick and heartbeat simulator remains within said interior pocket.

2. A doll playset as set forth in claim 1 wherein said pouch is formed of a soft padded material and includes strap means for supporting said pouch upon the front torso of a wearer.

3. A doll playset as set forth in claim 2 wherein said kick and heartbeat simulator includes:

a housing having a front portion and an interior cavity;

a motor;

a pair of extendable members each supported upon said front portion so as to be movable to and from said front portion;

drive means coupled to said motor and said extendable members including a rotating cam for moving said extendable members; and heartbeat means having a multiple lobed cam and resilient sounding element coupled thereto, said multiple lobed cam flexing said resilient sounding element.

4. A doll playset as set forth in claim 3 wherein said extendable members include buttons coupled to said cam.

5. A doll playset comprising:

a soft pouch having a front portion, a rear portion and an interior pocket;

a doll receivable within said interior pocket;

a housing external to and separate from said doll having a front portion received within said interior pocket;

a motor;

a motor driven gear supported within said housing having a front surface defining an undulating cam;

a heartbeat simulator;

a pair of buttons having head portions and push rods extending into said housing and contacting said undulating cam; and an on/off button coupled to said motor operable from said front portion of said housing, said on/off button being operated by pressing against said front portion of said pouch and said pair of buttons producing an undulating sensation upon said front portion of said pouch.

6. A doll playset comprising:

a pouch formed of a soft padded material and includes strap means for supporting said pouch upon the front torso of a wearer, said pouch having a front surface, a rear surface and an interior pocket;

a kick and heartbeat simulator supported within said interior pocket having a housing having a front portion and an interior cavity, a motor, a pair of expandable members each supported upon said front portion so as to be movable to and from said front portion, drive means coupled to said motor and said extendable members including a rotating cam for moving said extendable members, and heartbeat means having a multiple lobed cam and resilient sounding element coupled thereto, said multiple lobed cam flexing said resilient sounding element; and a doll removably supported within said interior pocket.

7. A doll playset as set forth in claim 6 wherein said extendable members include buttons coupled to said cam.

* * * * *